US005702528A

United States Patent [19]

Paramonov et al.

[11] Patent Number: 5,702,528

[45] Date of Patent: Dec. 30, 1997

[54] PROCESS FOR COATING THE SURFACE OF ELONGATED MATERIALS

[75] Inventors: Vladimir A. Paramonov; Anatolij I. Tychinin; Anatolij I. Moroz, all of Moscow, Russian Federation; Boris L. Birger, Riga, Latvia; Klaus Frommann, Meerbusch, Germany; Werner Haupt; Walter Ottersbach, both of Duisburg, Germany

[73] Assignees: Mannesmann Aktiengesellschaft, Düsseldorf, Germany; I.P. Bardin Central Research Institute of Iron and Steel Industry, Moscow, Russian Federation; SKB MGD, Institute of Physics, Riga, U.S.S.R.

[21] Appl. No.: 567,877

[22] Filed: Dec. 6, 1995

Related U.S. Application Data

[63] Continuation of Ser. No. 302,762, filed as PCT/DE93/00207, Mar. 4, 1993, abandoned.

[30] Foreign Application Priority Data

Mar. 13, 1992 [DE] Germany ..... 42 08 578.0

[51] Int. Cl.[6] ..... B05B 5/025

[52] U.S. Cl. ..... 118/623; 118/638; 118/404; 118/417

[58] Field of Search ..... 118/623, 638, 118/404, 419

[56] References Cited

U.S. PATENT DOCUMENTS

| | | | |
|---|---|---|---|
| 3,538,884 | 11/1970 | Carreker, Jr. | 118/7 |
| 4,169,426 | 10/1979 | Kornmann et al. | 118/67 |
| 5,084,094 | 1/1992 | Francois et al. | 75/663 |

FOREIGN PATENT DOCUMENTS

| | | | |
|---|---|---|---|
| 960311 | 9/1982 | U.S.S.R. | C23C 1/14 |

*Primary Examiner*—Benjamin Utech

*Attorney, Agent, or Firm*—Cohen, Pontani, Lieberman & Pavane

[57] ABSTRACT

The invention is directed to a process and apparatus for coating the surface of elongated materials, in particular steel strips, with a metallic coating. The material is guided in one direction through a tank holding the molten coating material. The tank has a through-duct surrounded by an electric field below the surface of the molten bath. An electromagnetic force is generated in the region where the through-duct opens into the melt, which electromagnetic force is equal to or greater than the metallostatic pressure, directed oppositely thereto vectorially and quantitatively proportional to the product of the cross-sectional area of the inlet opening and the metallostatic pressure, and in which the dwell of the strip in the melt can be controlled independently of the rate of feed of the strip. The molten is constantly moved against the surface of the elongated material while the elongated material passes through it; and the molten material is circulated in a closed system, without contact to oxygen in the atmosphere.

10 Claims, 3 Drawing Sheets

PROCESS FOR COATING THE SURFACE OF ELONGATED MATERIALS

This is a continuation of application Ser. No. 08/302,762, filed as PCT/DE93/00207 Mar. 4, 1993 now abandoned.

BACKGROUND OF THE INVENTION

1. Field Of The Invention

The invention is directed to a process for coating the surface of elongated materials, in particular steel strips, with a metallic coating in which the material is guided in one direction through a tank holding the molten coating material, said tank having a through-duct surrounded by an electric field below the surface of the molten bath, an electromagnetic force being generated in the region where the through-duct opens into the melt, which electromagnetic force is equal to or greater than the metallostatic pressure, directed oppositely thereto vectorially and quantitatively proportional to the product of the cross-sectional area of the inlet opening and the metallostatic pressure, and in which the dwell of the strip in the melt can be controlled independently of the rate of feed of the strip.

2. Description Of The Prior Art

In known installations for coating the surface of strip-shaped material, referred to as hot-dip galvanizing or dip-coating installations, the strip to be coated is introduced obliquely from above into the vessel holding the coating medium in a protective gas atmosphere and is deflected around a deflecting roller within the molten bath. The deflected material customarily exits the molten bath vessel in a vertical direction through suitable devices in which the coating material adhering to the strip surface, e.g. zinc, is adjusted in thickness and homogenized. Such devices, e.g. jet blades, remove excess coating materials so as to produce a smooth surface of uniform thickness.

The known installations however suffer from various disadvantages. The deflection of the strip in the molten coating material can cause the strip to run unevenly and slip on the roller and can impair the quality of the coated strip. The roller neck and bearing located in the bath are subject to accelerated wear and must be changed frequently, which always results in downtime for the entire installation. Neck wear and bearing wear can lead to vibrations in the strip and can cause changes in the distance between the strip and the wiping or stripping jets which negatively affects the uniformity of the coating along the length and width of the strip. The deflection of the strip within the vessel calls for a tank of larger volume with a commensurately greater quantity of coating material. This makes it very difficult to control the dwell time of the strip in the bath and very time-consuming to fill and empty the tank when changing the coating material.

In other known installations for coating elongated materials, the materials are guided through the molten coating material in a horizontal or vertical direction (FR-A 22 29 782 and E-B 1-00 60 225). Such installations in which the elongated material to be coated is guided through or into the molten coating material in regions below the surface of the molten bath require suitable sealing to prevent the escape of coating material from the coating tank.

Soviet Inventor's Certificate No. 960311 discloses a suggestion for sealing the treatment tank for elongated materials traveling upward vertically through the tank. The arrangement described therein has a tank filled with molten coating material with a through-opening in its base for the materials to be coated, this through-opening being sealed by an electromagnetic pump. By means of an immersion body which dips into the molten coating material and likewise cooperates with an electromagnetic pump, the effective level of molten coating material is regulated so that the duration of contact of the elongated materials with the molten coating material may be adjusted. The electromagnetic pump which is immersed in the melt along with the immersion body serves to prevent highly contaminated oxides from coming in contact with the surface of the elongated material to be coated. A high-quality coating is achieved even with brief contact with the melt.

The period of contact, intensity of contact, the temperature of the material to be coated and the temperature of the molten coating material also determine the development and thickness of the intermetallic intermediate layer. This is very important for the adhesion and quality of the coating and in particular for the deformation capacity of the coating. Known devices do not take this into account. Accordingly, it is not possible in installations of the prior art to influence the formation of the intermediate layer by short-term adjustments in the temperature of the melt and the temperature of the material to be coated and short-term changes in the duration of contact of the material to be coated with the molten coating material. Further, the known installations are very costly in terms of construction and the melt can be relatively highly contaminated by oxides, iron or, if zinc is used, by light and heavy spelter or hard zinc which impair the quality of the coating.

SUMMARY OF THE INVENTION

Proceeding from the disadvantages and problems of the prior art described above, the object of the present invention is to improve the conventional strip coating process in order to achieve favorable intermediate layers for good adhesion and a good deformability of the coating and, at the same time, to improve the surface quality, thickness tolerances of the layer and mechanical properties of the material to be coated and to minimize contamination of the melt by oxides, iron and hard zinc. In so doing, the coating material to be applied should adhere firmly even to imperfect surfaces of the steel strip. A considerable reduction in energy, production costs, maintenance costs and investment costs as well as a quick changing of the coating material are also possible.

This object is met according to the invention by a process of the type described above in that the molten coating material is constantly moved against the surface of the elongated materials and is circulated out of contact with atmospheric oxygen while the elongated material passes through the molten coating material. It has been shown that particularly favorable coating results can be achieved when the molten coating material is kept in motion in the region of contact with the surface of the material to be coated as suggested by the invention and fresh coating material is continuously furnished to the strip by circulating the coating material in a closed system without contact between the melt and atmospheric oxygen. Moreover, the size of hard zinc particles is minimized by the movement of the bath.

In the process according to the invention short-term adjustments can advantageously be made in the temperature of the molten coating material and/or in the temperature of the elongated material. It is possible in this way to create optimal conditions for the formation of the intermediate layer and for the adhesion of the coating material as required.

In an advantageous development of the invention the molten coating material is cleaned of impurities while circulating. In this way it is ensured that the impurities causing a deterioration in coating quality do not even come into contact with the material to be coated.

A device for carrying out the process is characterized in that a pre-melt tank is associated with the coating tank holding the molten coating material, and the melt can be circulated between this pre-melt tank and the coating tank out of contact with atmospheric oxygen. In a further advantageous development, the coating tank is constructed so as to be many times smaller in volume than the pre-melt tank, preferably in a ratio of 1:10.

In a system of this type having a separate coating tank and pre-melt tank, fresh melt which is free of impurities such as hard zinc can constantly be supplied as directly as possible to the surface of the material to be coated by means of a suitable proportioning or distributing system, wherein it is possible to temporarily regulate the temperature of the melt within a close range of tolerances in the relatively small coating tank via the feed paths. The pre-melt tank is suitable for smelting coating material in the form of slabs. The level of the molten coating material in the smaller coating tank can be increased and decreased very quickly by means of pumps.

In another favorable embodiment of the invention the pre-melt tank is arranged laterally below the coating tank.

A particularly advantageous installation in which the coating tank can be filled and emptied very quickly when necessary is provided according to another feature of the invention in that known electromagnetic pumps are provided for circulating the molten coating material and in that the molten coating material is returned to the pre-melt tank from the treatment tank by the force of gravity.

According to a preferred construction of the device according to the invention, the coating tank is divided into an inner vessel at whose base is arranged the through-opening for the elongated material and an outer vessel which encloses the inner vessel at least partially and whose walls are higher than those of the inner vessel. The outer vessel and inner vessel are each connected separately with the pre-melt tank via inlet ducts and outlet ducts for the molten coating material. A system constructed in this way enables an advantageous connection between the pre-melt tank and the coating tank on the one hand and an accurate regulating of the coating in the coating tank on the other hand, the volume of molten coating material contained in the coating tank being limited to the necessary minimum. Since the entire system operates out of contact with atmospheric oxygen, particularly favorable coating results can be expected.

The liquid column of molten coating material can be effectively adjusted in that the immersion body, known per se, which encircles the elongated material with an electromagnetic seal is guided in the inner vessel in such a way that it can be raised and lowered. The molten coating material can be displaced with the aid of this immersion body until the desired bath level is reached, wherein the electromagnetic seal keeps coating material away from the portion of the elongated material passing through the immersion body. The coating material displaced by the immersion body overflows the walls of the inner vessel into the outer vessel and flows back again to the pre-melt tank.

According to another feature of the invention, the pre-melt tank itself is divided into an open vessel part and a closed vessel part, wherein the inlet duct leading to the inner vessel of the treatment tank is connected with the closed vessel part and the outlet duct of the outer vessel is connected with the open vessel part of the pre-melt tank. In this way it is ensured that no atmospheric oxygen which could contaminate the melt can reach the closed system when fresh molten coating material is supplied. The outlet duct connected with the outer vessel opens into the molten coating material in the open vessel part so that no oxygen can enter.

A magnetic pump enclosing the inlet duct is provided in the region of the closed vessel part of the pre-melt tank for conveying the molten coating material to the inner vessel through the inlet duct. The molten coating material can be transported from the closed vessel part of the pre-melt tank to the inner vessel of the treatment tank by means of this magnetic pump which can be raised and lowered in the longitudinal direction of the inlet duct.

A charging device is associated with the open vessel pan of the pre-melt tank so that the coating material, e.g. in the form of slabs, can be introduced into the melt and the supply of coating material can be constantly refreshed.

In another advantageous construction of the device according to the invention, a return-flow cut-off for the molten coating material is provided below the through-opening in the inner vessel for the elongated material within the duct enclosing the latter, an outlet duct leading to the open vessel pan of the pre-melt tank being guided between the return-flow cut-off and the through-opening. This return-flow cut-off is provided so that no molten material can reach the feed portion of the elongated material to be coated in the event of leakage or in case it is necessary to quickly evacuate the treatment tank. Melt which penetrates into the through-opening can be captured in the return-flow cut-off and guided back into the supply tank via the outlet duct.

In a further construction of the invention the return-flow cut-off can be closed mechanically, preferably by means of a gate lock or slide lock whose slide plate is constructed as shearing knives for severing the elongated material. In an emergency, the strip can also be severed by means of this return-flow cut-off and the through-opening can be closed at the same time.

Of course, it is also conceivable within the framework of the present invention to provide a plurality of pre-melt tanks associated with the coating tank and to provide them with different coating materials. In principle, the elongated materials to be coated can run vertically in either direction.

The invention is explained with reference to embodiment examples which are shown in the drawing and described in the following.

DETAILED DESCRIPTION OF THE PREFERRED EMBODIMENTS

Figure 1:
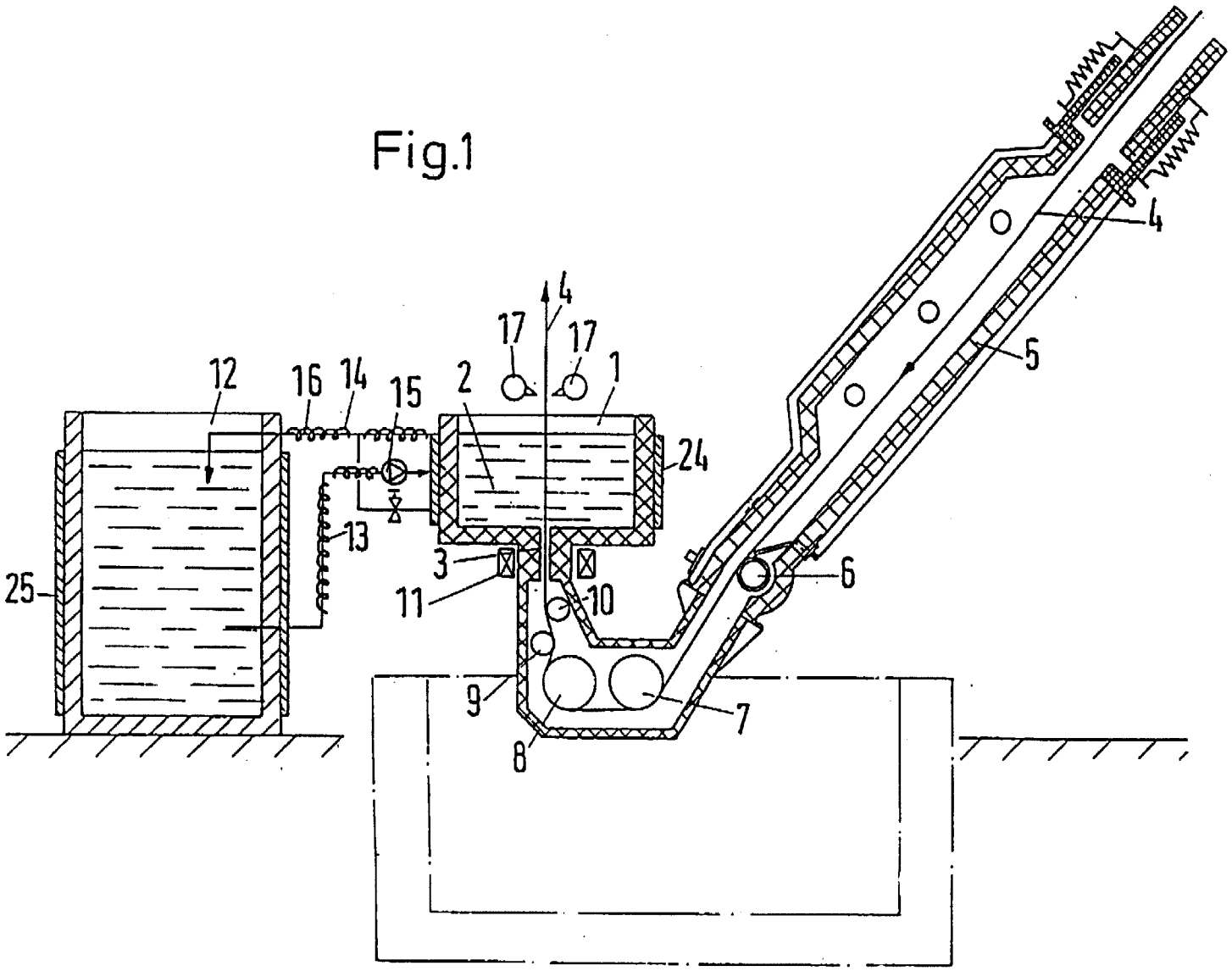
FIG. 1 shows a cross section through a device according to the invention for coating strip steel.

FIG. 1 shows the coating tank 1 which receives the coating material (melt 2) of liquid zinc. The coating tank 1 has a through-duct 3 at its base through which the strip 4 can be guided through the coating material vertically upward. After leaving the furnace (not shown), the strip 4 is guided through the furnace shaft or trunk, so called, by rolls 6, 7, 8, 9 and 10. The furnace trunk is operated in a protective gas atmosphere, i.e. it is closed against contact with atmospheric oxygen between the furnace and coating tank 1.

The rolls 9 and 10 ensure that the strip 4 is guided through the slot-shaped through-duct 3 into the treatment tank 1 without making contact. The duct 3 itself is enclosed by a coil 11 in which is generated an electromagnetic field which in turn generates an electromagnetic force preventing the melt 2 from flowing out of the tank 1.

The pre-melt tank 12, which holds a substantially greater volume of molten zinc than the coating tank 1, is set up next to the coating tank 1. The pre-melt tank is connected with the coating tank 1 via inlet ducts 13 and outlet ducts 14. The molten metal is pumped from the pre-melt tank 12 into the coating tank 1 by pump 15. The feed line and outlet line are provided with heating devices 16 by which the temperature of the melt 2 can be adjusted. It will also be seen in FIG. 1 that a conventional jet blade 17 which provides for a uniform coating thickness of the zinc material, but which is not the subject of the present invention, is arranged above the coating tank 1.

Figure 2:
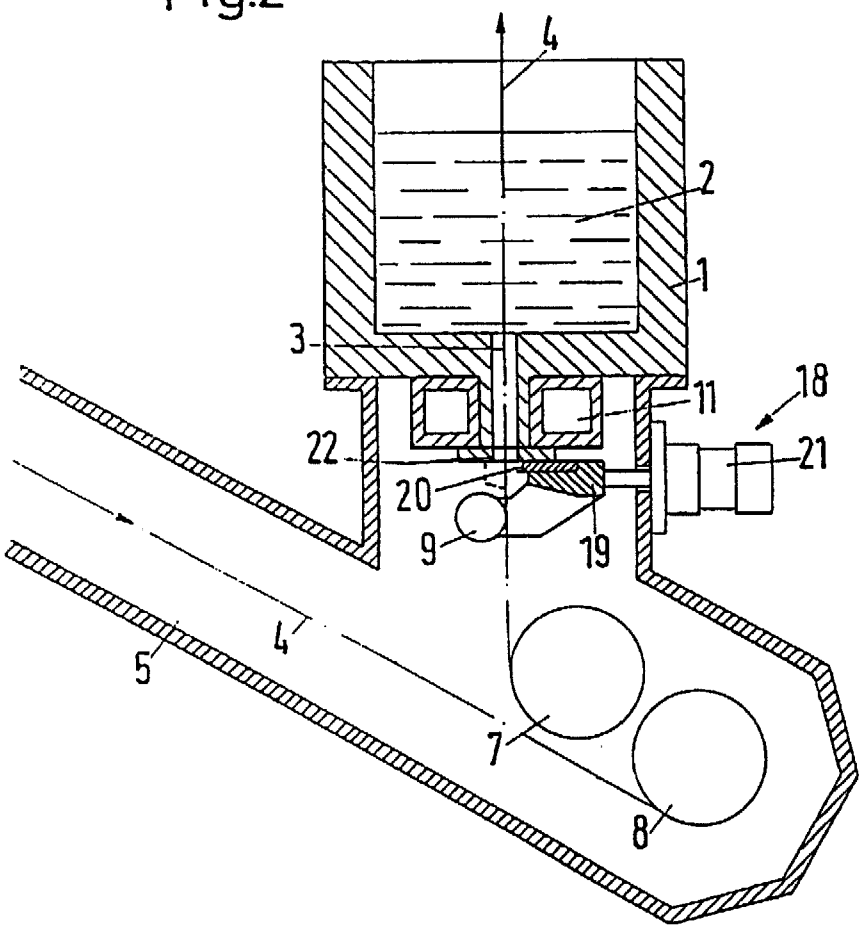
FIG. 2 shows the mechanical sealing of the coating tank for emergencies.

FIG. 2 shows an enlarged view of the coating tank 1 receiving the zinc bath 2. The lower through-opening 3 is sealed electromagnetically as shown at 11. The strip 4 is guided through the furnace trunk 5 in a protective gas atmosphere into the coating tank 1. In order to exert the necessary traction on the strip, the rolls 7 and 8 are constructed as S-rolls which are also heated and/or cooled.

In emergency situations, that is, if the electromagnetic seal should fall, e.g., due to power outage, the duct 3 in the tank 1 can be closed by means of a combined shears/slide system 18, whereupon the strip 4 is severed. For this purpose, the slide 19 is provided with a shear knife 20 which is movable (from right to left with reference to the drawing plane) with the slide 19 by means of a piston-cylinder unit 21 and severs the strip 4 while at the same time closing the duct 3. The guide roll 9 arranged at the slide 19 moves toward the side along with the slide 19 so that the strip 4 abuts at the edge 22 of the opening 3.

Figure 3:
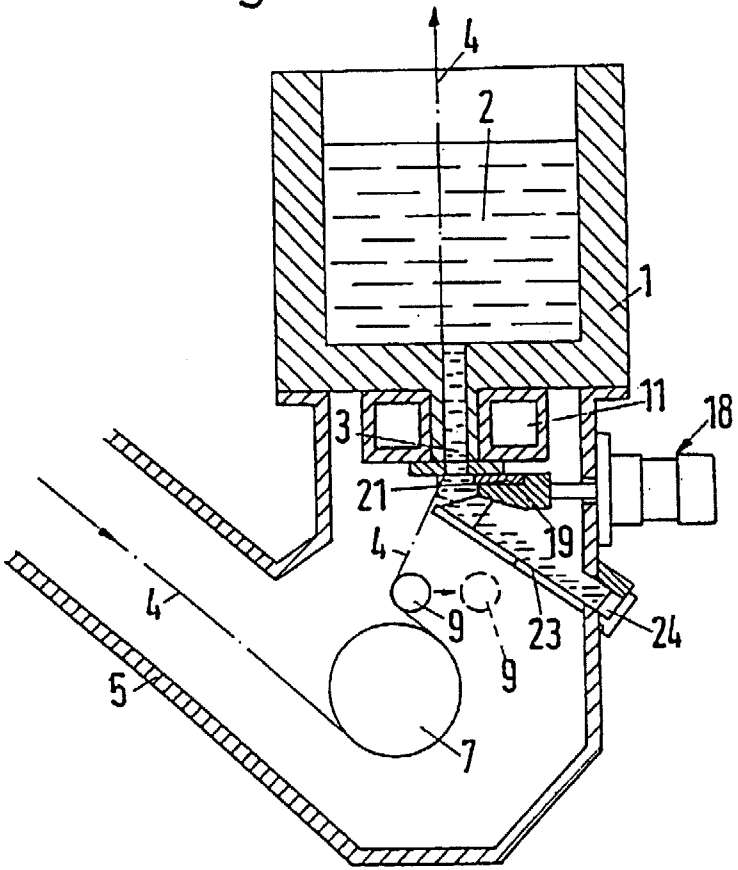
FIG. 3 shows a device for quick evacuation of the melt.

Identical parts are provided with the same reference numbers in FIG. 3. In this embodiment example only one heated or cooled deflecting roll 7 is provided. The guide roll 9 is displaceable transversely to the strip in order to deflect the strip 4 laterally out of the plane of travel through the duct 3. This is to allow the zinc to run out of the coating tank 1 without obstruction via the collecting gutter 23 arranged below the duct 3 when emptying the coating tank 1. The molten zinc can be guided back into the pre-melt kettle 12 via the outlet 24 by means of suitable pumps. The shut-off unit combined with shears for severing the strip which can be actuated in emergency situations is also provided in this embodiment example.

Referring to FIG. 1, it will be seen that the coating tank 1 and pre-melt tank can be heated by induction or by electrical resistance heating as indicated at 24 and 25.

Figure 4:
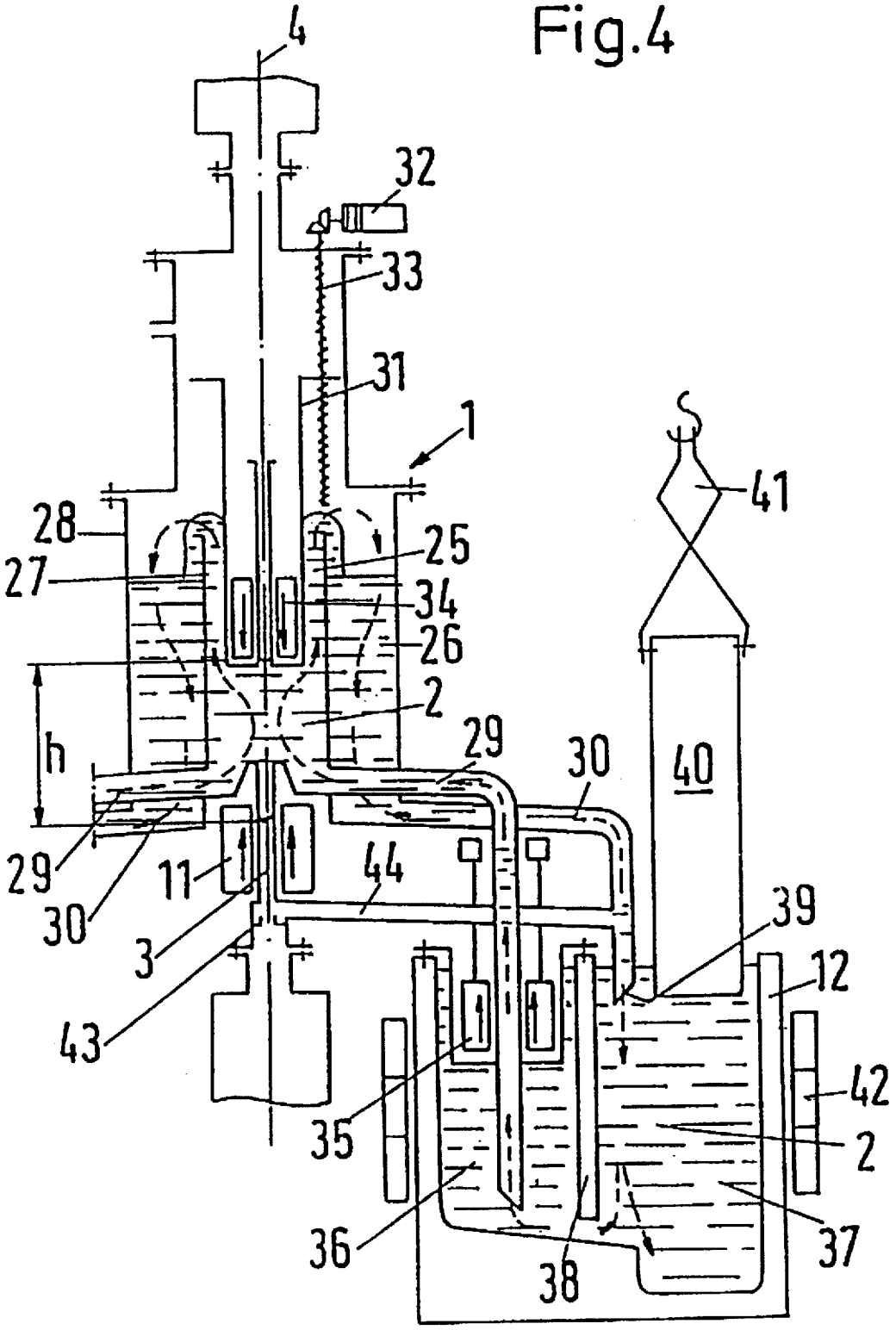
FIG. 4 shows another preferred device for coating strip material.

Another particularly advantageous construction of the device according to the invention is shown in FIG. 4. As in Figure 1 of the drawing, the coating tank is designated by 1 and the pre-melt tank by 12. The coating tank 1 is divided into an inner vessel 25 and an outer vessel 26, the wall 27 of the inner vessel 25 being lower than the outer wall 28 of the outer vessel 26. The through-duct 3 for the strip 4 is provided at the base of the inner vessel 25 and is sealed by the coil 11 of the electromagnetic seal as was already described in the preceding. The inlet ducts 29 through which the zinc is pumped out of the pre-melt tank 12 into the inner vessel 25 of the coating tank 1, as will be described in more detail below, are likewise connected at the base of the inner vessel 25.

The outer vessel 26 is connected, also at the base, with outlet ducts 30 which are guided into the pre-melt tank 12.

To adjust the level h of the melt bath, an immersion body 31 can be raised and lowered in the inner vessel 25 of the coating tank I by means of a spindle drive 33. A magnetohydrodynamic seal 34 enclosing the strip 4 is provided inside the immersion body 31. The immersion body 31 displaces the coating material 2 in the inner vessel 25 to the desired height h, while the magnetohydrodynamic seal 34 prevents the coating material 2 from penetrating into the immersion body 31.

The electromagnetic pump 35 serves to transport the coating material 2 from the pre-melt tank 12. It delivers the coating material 2 directly to the inner vessel 25 through the inlet duct 29, wherein two inlet ducts 29 are advantageously arranged at either side of the strip in such a way that there is a uniform flow of coating material 2 on both sides of the strip. After the surface of the strip is wetted, excess coating material is pumped out via the wall 27 of the inner vessel 25 and runs into the outer vessel 26. It then arrives back in the pre-melt tank 12 via the flow-off ducts 30.

The pre-melt tank 12 is likewise divided into two vessel pans, one of which 36 is closed, while the other vessel part 37 is open at the top. The two vessel pans 36, 37 are separated from one another by a wall 38 which is open in the region of the bottom. The closed vessel part 36 is closed by a barrel-shaped cover which dips into the coating material 2, the electromagnetic pump 35 enclosing the inlet duct 29 being arranged in this cover.

The outlet duct 30 leading out of the outer vessel 26 opens into the open vessel pan at 39. At the same time, the vessel part which is open at the top allows the molten coating material 2 to be charged in slabs 40 of solid coating material which is fed via a charging device 41. As indicated at 42, the pre-melt tank 12 can be heated by induction heating.

A return-flow cut-off for molten coating material which could flow through the through-opening 3 in the event of leakage is provided below the through-opening 3 as indicated at 43.

The return-flow cut-off 43 communicates with a discharge duct 44 which is connected in turn to the flow-off duct 30 leading out of the outer vessel 26.

The entire installation is operated in a protective gas atmosphere so that the entire system—with the exception of the open portion of the pre-melt tank 12— is sealed off from atmospheric oxygen.

A continuous and intensive circulation of the coating material in a counterflow directed opposite to the traveling direction of the strip can be achieved by the device according to the invention as shown in FIG. 4. The melt 2 is pumped out of the closed part 36 of the pre-melt tank 12 through the inlet ducts 29 into the lower pan of the inner vessel 25, where it comes into intensive contact with the surface of the strip 4 to be coated. The flow of melt 2 continues into the upper part of the inner vessel 25 where it flows over the walls 27 of the latter into the outer vessel 26. The melt then flows back into the open part 37 of the pre-melt tank 12 via the return ducts 30. The inner vessel 25 is closed at the bottom by the magnetohydrodynamic seal as in the embodiment example shown in FIG. 1. The magnetic field in the magnetohydrodynamic seal 34 in the region of the immersion body 31 is directed downward so that none of the melt can penetrate into the immersion body. In this way, the desired column of coating material in the inner vessel 25 can be adjusted very simply and, above all, very quickly. The intensive wetting of the surface of the strip with the melt permits a very fast layer formation and enables a controlled adjustment of the thickness of the intermetallic layer.

The closed, air-tight circulating system of the melt 2 and strip 4 in a protective gas atmosphere eliminates contact between the melt and atmospheric oxygen and accordingly reliably prevents oxidation. Since there are no deflecting means or other metal parts in the melt bath, the formation of light and heavy hard zinc is reduced. The pre-melt tank 12, with its open part 37 and its closed part 38, acts as a communicating pipe with the dividing wall 38 and enables a continuous supply of coating material in the form of slabs for smelting. Hard zinc impurities on the surface of the melt can be removed in the open part 37 of the pre-melt tank 12. The impurities are prevented from entering the closed part 36 of the pre-melt tank 12.

The invention advantageously enables an optimal coating of elongated material with molten coating material with a very brief contact time and optimal adhesion properties. The thickness of the intermetallic layer can be regulated easily and impurities in the melt due to iron and oxides are prevented to a great extent. The energy required to operate an installation is substantially reduced and the quality of the coated material is improved. Downtime for the installation is considerably reduced owing to the absence of parts which are subject to wear (deflecting rolls in the melt) so that the economic efficiency of the installation is noticeably increased.

We claim:

1. A device for coating the surface of an elongated material with a metallic coating, comprising:

(a) a coating tank containing a molten coating material bath, the coating tank being divided into an inner vessel having a base and an outer vessel provided so as to at least partially enclose the inner vessel, the outer vessel having walls that are higher than those of the inner vessel;

(b) a through-duct arranged at the base of the coating tank below the surface of the molten material;

(c) means for generating an electromagnetic force in a region where the through-duct opens into the molten material, said electromagnetic force being at least equal to the weight of the molten material and directed oppositely thereto and quantitively proportional to the product of the cross-sectional area of the through-duct opening and the metallostatic pressure to prevent the molten material from flowing out the through-duct;

(d) a pre-melt tank associated with the coating tank and also containing a molten material bath, the coating tank enclosing a volume that is substantially smaller than a volume enclosed by the pre-melt tank; and (e) means for connecting together the coating tank and the pre-melt tank and for adjusting the melt bath level in the coating tank by transferring the molten material back and forth between the tanks, the connecting means including duct means for separately connecting the outer vessel and the inner vessel to the pre-melt tank for passage of the molten coating material.

2. The device according to claim 1, wherein the volume of the coating tank is ten times smaller than the volume of the pre-melt tank.

3. The device according to claim 1, wherein the pre-melt tank is arranged laterally below the coating tank, and further comprising electromagnetic pump means for circulating the molten coating material in the tanks.

4. The device according to claim 1, and further comprising an immersion body arranged in the inner vessel so that it can be raised and lowered in order to adjust the bath level, and means for raising and lowering the immersion body, the immersion body having a magnetohydrodynamic seal that encircles the elongated material.

5. The device according to claim 1, wherein the pre-melt tank is divided into an open vessel part and a closed vessel part, the duct means including an inlet duct connected between the closed vessel part of the pre-melt tank and the inner vessel of the coating tank, and an outlet duct connected between the outlet vessel part of the pre-melt tank and the outer vessel of the coating tank.

6. The device according to claim 5, wherein the inlet duct leading to the inner vessel is enclosed by the electromagnetic pump means in a region of the closed vessel part of the pre-melt tank.

7. The device according to claim 5, and further comprising charging means associated with the open vessel part of the pre-melt tank for charging the coating material into the pre-melt tank.

8. The device according to claim 5, and further comprising return flow cut-off means provided below the through-duct for the elongated material for blocking the molten coating material, and an outlet duct connected to the through-duct ahead of the return flow cut-off means and leading to the open vessel part of the pre-melt tank.

9. The device according to claim 8, wherein the return flow cut-off means is mechanically closeable.

10. The device according to claim 8, and further comprising slide lock means for closing the return flow cut-off means, said slide lock means including a slide plate constructed as shearing knives for severing the elongated material.

* * * * *